US006551116B1

(12) United States Patent
Liu

(10) Patent No.: US 6,551,116 B1
(45) Date of Patent: Apr. 22, 2003

(54) ELECTRICAL CONNECTOR HAVING DIELECTRIC SPACER

(75) Inventor: Qiang Liu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/104,962

(22) Filed: Mar. 22, 2002

(30) Foreign Application Priority Data

Dec. 21, 2001 (TW) ..... 90222535

(51) Int. Cl.[7] ..... H01R 12/00

(52) U.S. Cl. ..... 439/79; 439/567

(58) Field of Search ..... 439/79, 80, 570, 439/571, 567, 701

(56) References Cited

U.S. PATENT DOCUMENTS

| | | | | | |
|---|---|---|---|---|---|
| 5,591,036 | A | * | 1/1997 | Doi et al. | 439/79 |
| 5,722,839 | A | * | 3/1998 | Yeh | 439/79 |
| 6,077,092 | A | * | 6/2000 | Chiu et al. | 439/79 |
| 6,093,033 | A | * | 7/2000 | Kuki et al. | 439/79 |
| 6,116,917 | A | * | 9/2000 | Choy | 439/79 |

* cited by examiner

*Primary Examiner*—Hien Vu
(74) *Attorney, Agent, or Firm*—Wei Te Chung

(57) ABSTRACT

An electrical connector (10) includes an insulative housing (12), a number of electrical contacts (18), a pair of dielectric spacers (22), a pair of latches (24) and a pair of board locks (30). The latches and the board locks are assembled to the insulative housing. The insulative housing has a body portion (120) defining a receiving slot (121) and the electrical contacts are received in the insulative housing to be exposed to the receiving slot. The insulative housing has a pair of end blocks (125) and an intermediate block (126) each formed with mechanisms for retaining the dielectric spacers therebetween.

1 Claim, 9 Drawing Sheets

ELECTRICAL CONNECTOR HAVING DIELECTRIC SPACER

BACKGROUND OF THE INVENTION

1. Field of the Invention

The present invention relates to an electrical connector, and particularly to an electrical connector having a dielectric spacer.

2. Description of the Related Art

A dielectric spacer is usually provided in an electrical connector for alignment of electrical contacts of the electrical connector so that tails of the electrical contacts can be correctly inserted into corresponding holes in a printed circuit board on which the electrical connector is mounted. As is disclosed in U.S. Pat. Nos. 5,601,438 and 5,709,556, each of most spacers used with the electrical connectors includes a plate with several through-holes therein and fastened to an insulative housing of the electrical connector by means of retaining latch devices generally positioned at two ends of the plate. The retaining latch devices of the dielectric spacer and structures formed on the insulative housing to correspond to the retaining latch devices are always complicatedly constructed for ensuring a mechanical retention therebetween. For general electrical connectors whose dimensions are not so small, those structures are acceptable.

However, some electrical connectors have very small dimensions and either insulative housings or dielectric spacers of the electrical connectors are so tiny that it is nearly impossible to form such complicated latch structures.

So-called floating spacers as shown in U.S. Pat. No. 6,116,917, which are not retained to the insulative housings of the electrical connectors, have been proposed to solve the above problems and they do, to some extent, work in many applications. Nevertheless, the tails of the electrical contacts of the electrical connector are often bent with respect to contact portions of the electrical contacts before inserting into the through holes of the spacers. These bent tails are subject to residual stress and subsequent stress relaxation problems which tend to move the tails of the electrical contacts together with the floating spacers, thereby adversely affecting the positioning of the tails with respect to the holes of the printed circuit board. Therefore, an improved electrical connector is desired.

SUMMARY OF THE INVENTION

A major object of the present invention is to provide an electrical connector having a dielectric spacer which has simplified latching structures with respect to an insulative housing of the electrical connector to reliably ensure positions of tails of electrical contacts of the electrical connector.

An electrical connector in accordance with the present invention comprises an insulative housing, a plurality of electrical contacts, a pair of dielectric spacers, a pair of latches and a pair of boardlocks. The latches and the boardlocks are assembled to the insulative housing. The insulative housing defines a receiving slot and the electrical contacts are received in the insulative housing to expose to the receiving slot. The insulative housing comprises a pair of end blocks and an intermediate block each formed with means for retaining the dielectric spacers therebetween.

Other objects, advantages and novel features of the invention will become more apparent from the following detailed description of the present embodiment when taken in conjunction with the accompanying drawings.

DETAILED DESCRIPTION OF THE INVENTION

Figure 1:
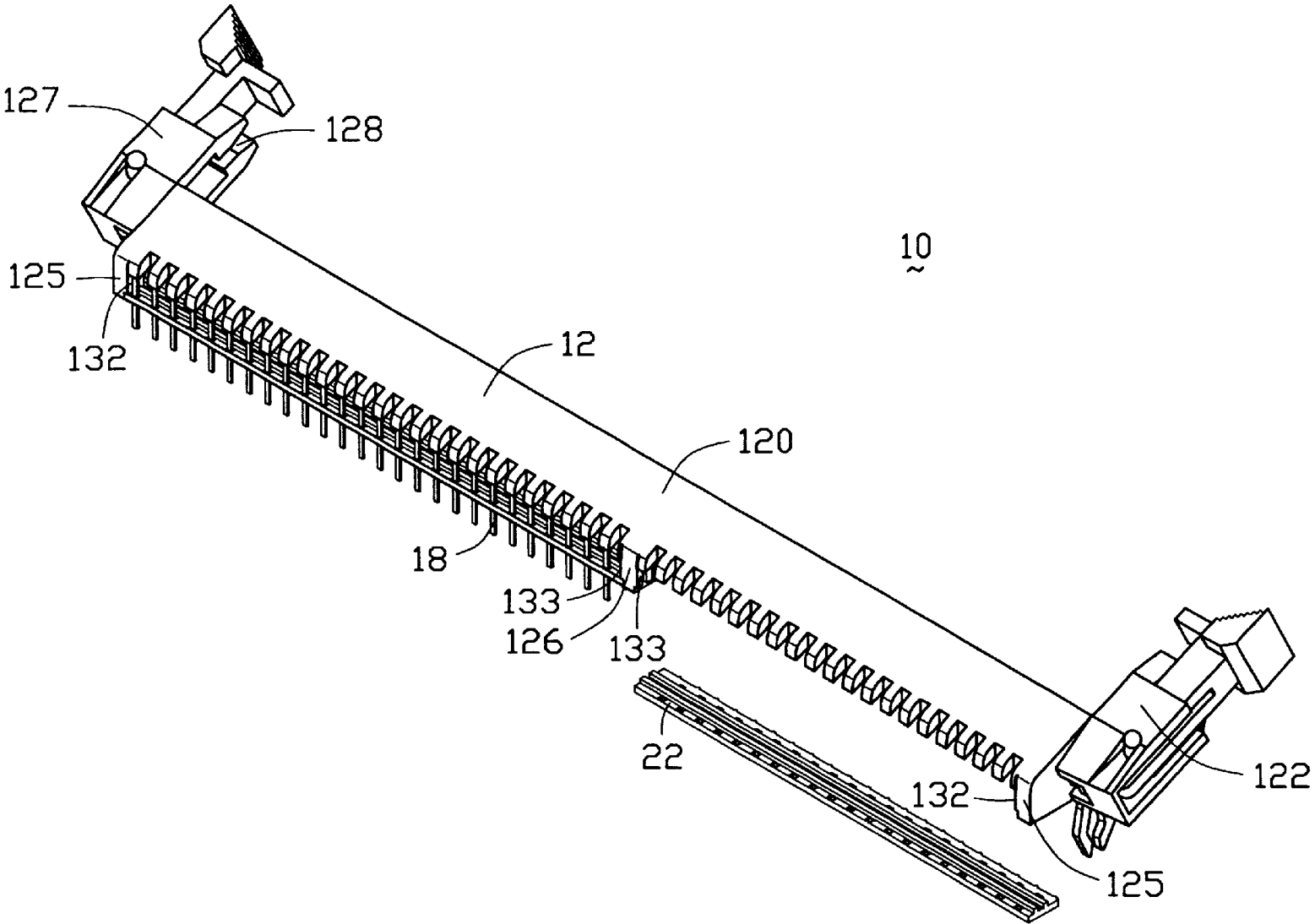
FIG. 1 is a perspective view of an electrical connector in accordance with a first embodiment of the present invention but a dielectric spacer thereof is disengaged therefrom and some electrical contacts thereof corresponding to the dielectric spacer are removed.

It will be noted here that for a better understanding, most of like components are designated by like reference numerals through various figures in the embodiments.

Figure 2:
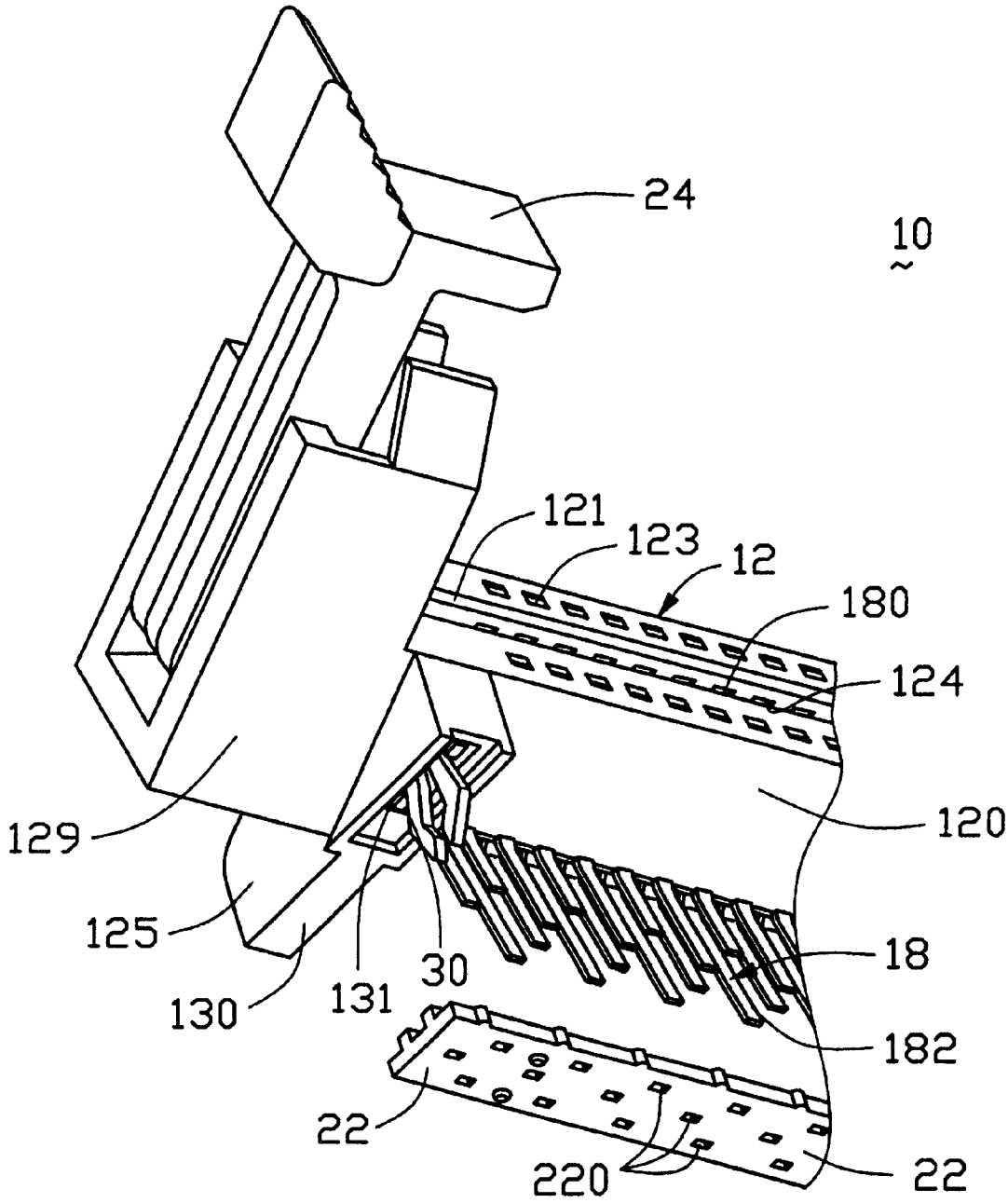
FIG. 2 is a partly enlarged perspective view of the electrical connector of FIG. 1 taken from another perspective.

Please refer to FIGS. 1 and 2, an electrical connector 10 in accordance with a first embodiment of the present invention comprises an insulative housing 12, a plurality of electrical contacts 18, a pair of dielectric spacers 22, a pair of latches 24, and a pair of boardlocks 30 (only one shown).

The insulative housing 12 comprises an elongated body portion 120, a pair of parallel shoulders 122 extending at two opposite longitudinal ends of the body portion 120, a pair of end blocks 125 extending rearwardly from the body portion 120 and adjacent to the shoulders 122, respectively, and an intermediate block 126 extending rearwardly between the pair of end blocks 125. The body portion 120 defines a receiving slot 121 extending along a length thereof for receiving a card or module (not shown), a plurality of passageways 123 extending along two opposite sides of the receiving slot 121 and a plurality of openings 124 each exposing a corresponding passageway 123 to the receiving slot 121.

Each of the shoulders 122 comprises a pair of arms 127 spaced from each other by a groove 128 therebetween. As is shown in FIG. 2, bottom faces 129 of the shoulders 122 and of the body portion 120 are flush with each other to be located in a plane. The shoulders 122 extend forwardly beyond the body portion 120 and the end and the intermediate blocks 125, 126 and the intermediate and the end blocks 126, 125 extend rearwardly beyond the shoulders 122 and the body portion 120.

Figure 3:
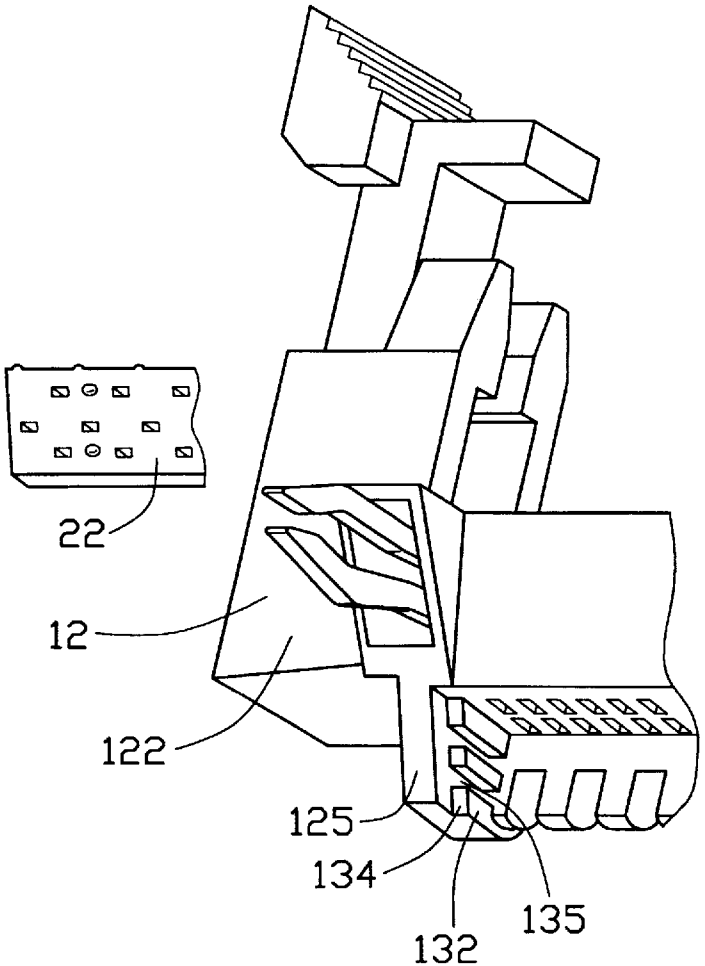
FIG. 3 is a partly enlarged view of the electrical connector of FIG. 1 without the presence of electrical contacts thereof.

Referring also to FIG. 3, each of inner walls 132 of the end blocks 125 and each of the outer walls 133 of the intermediated block 126 of the insulative housing 12 are formed with a step portion 134 adjacent to a lower section thereof and a pair of channels 135 extending in the step portion 134. Bottom faces 130 of the end blocks 125 and of the intermediate block 126 are flush with each other to define a plane having an acute angle with respect to the plane defined by the bottom faces 129 of the body portion 120 and the shoulders 122, whereby when the electrical connector 10 is mounted to a printed circuit board (not shown), the card or module could be slantedly inserted into the receiving slot 121. Each end block 125 defines a slit 131 recessed from the bottom face 130 thereof.

Each of the electrical contacts 18 comprises a contact portion 180 received in a corresponding passageway 123 of the insulative housing 12 and protruding through a corresponding opening 124 into the receiving slot 121 to electrically contact with the card or module, and a tail 182 bent with respect to the contact portion 180 and extending beyond the bottom faces 129, 130. Since the electrical contacts 18 are the same as are used in conventional electrical connectors, a detailed description thereabout is omitted herefrom.

Figure 4:
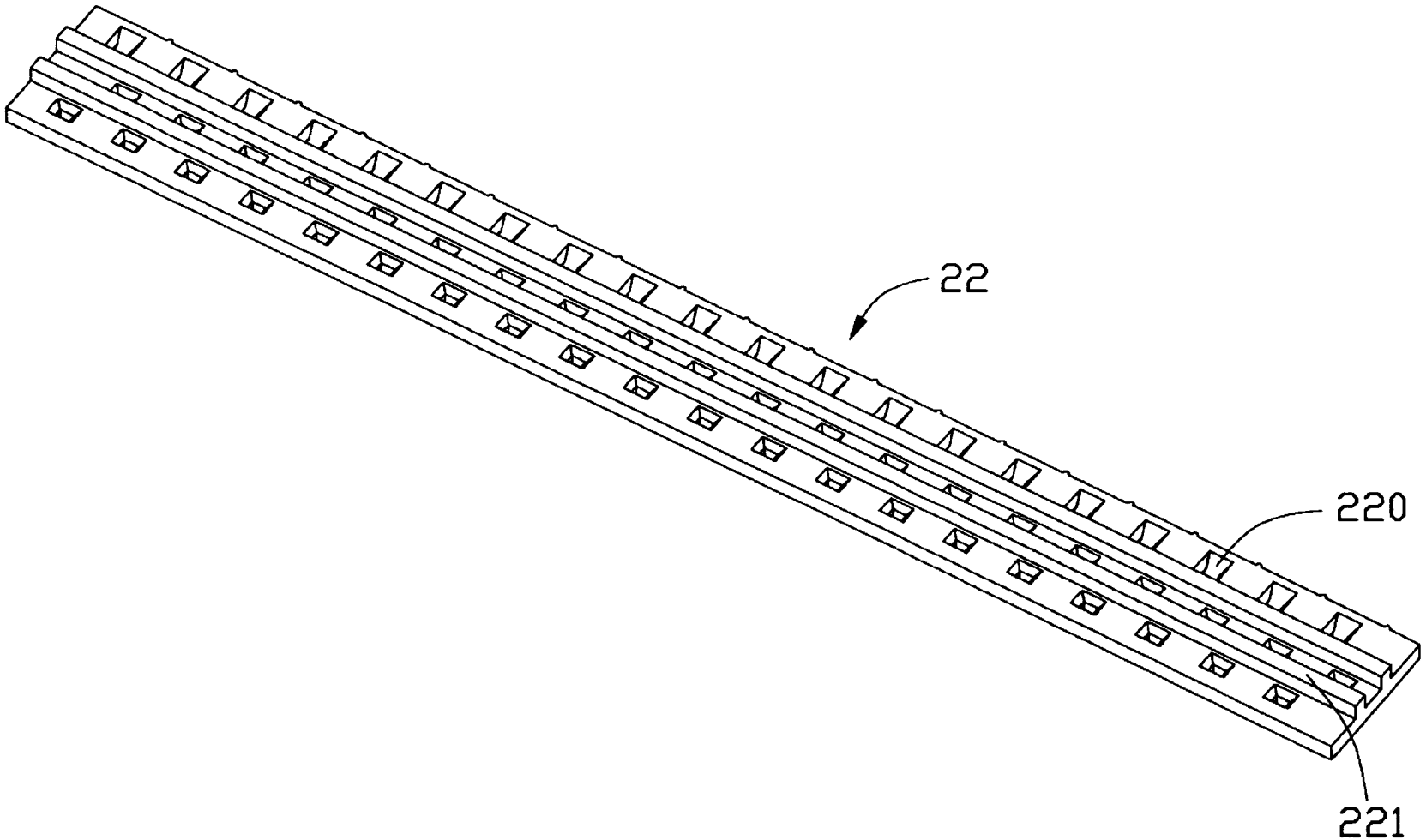
FIG. 4 is a perspective view of the dielectric spacer of the electrical connector of FIG. 1.
Figure 5:
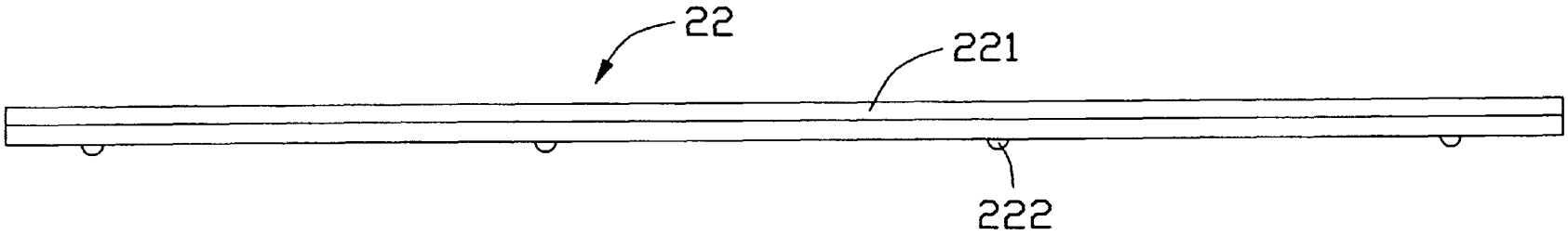
FIG. 5 is a front view of the dielectric spacer of FIG. 4.
Figure 6:
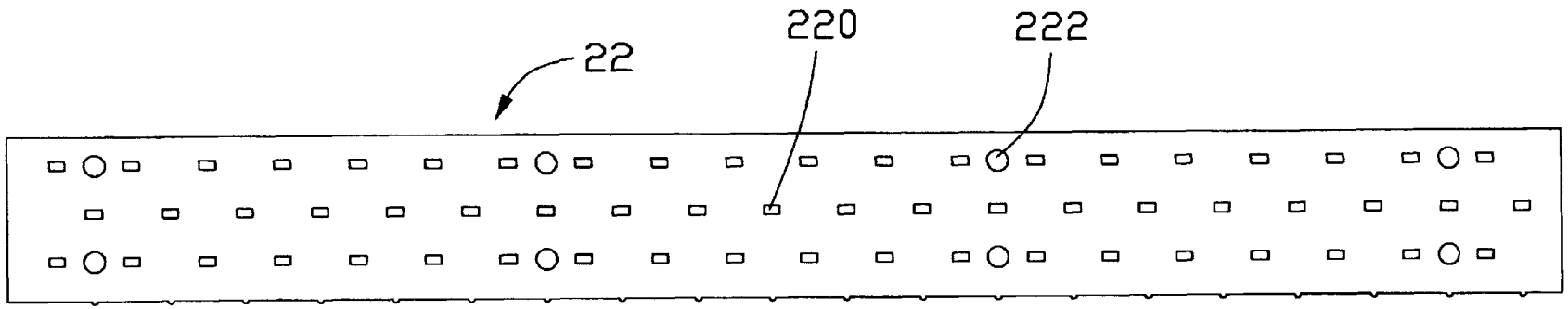
FIG. 6 is a bottom plan view of the dielectric spacer of FIG. 4.

Referring also to FIGS. 4–6, each dielectric spacer 22 is generally a longitudinally extending plate and defines three rows of through holes 220 extending vertically therethrough, a pair of ribs 221 extending upwardly along a length thereof from a top face thereof and located between every two adjacent rows of through holes 220, and a plurality of bumps 222 protruding downwardly from a bottom face thereof.

The latches 24 are configured in ways known to one of ordinary skill in the pertinent art to be movably assembled in the grooves 128 between the arms 127 of the shoulders 122 of the insulative housing 12 to latch the card or module in the receiving slot 121 when desired, so detailed descriptions therefor are omitted herefrom. Furthermore, the electrical connector 10 can also be formed without the latches 24, when the card or module needs not such a retention to the insulative housing 12.

The boardlocks 30 are also configured in ways known to persons skilled in the pertinent art and are assembled in the slits 131 of the end blocks 125 in ways also known to persons skilled in the pertinent art for retaining the electrical connector 10 to a printed circuit board (not shown), detailed descriptions therefor are thus omitted herefrom. The boardlocks 30 can also be omitted on the condition that the electrical connector 10 is reliably mounted on the printed circuit board.

In assembly, the tails 182 of the electrical contacts 18 extend through the through holes 220 of the dielectric spacers 22 and two opposite ends of the dielectric spacers 22 engage with the step portions 134 of the end and the intermediate blocks 125, 126 while the ribs 221 are interferentially fitted against the channels 135.

Figure 7:
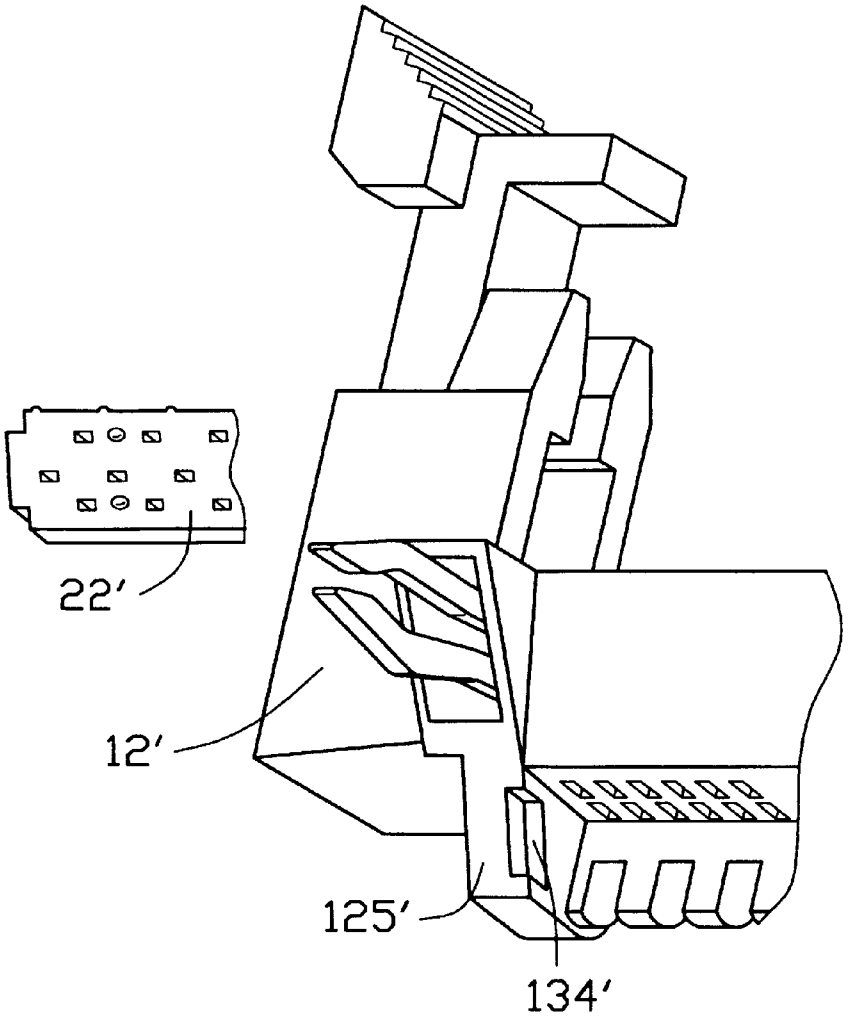
FIG. 7 is a partly enlarged view of an electrical connector in accordance with a second embodiment of the present invention without the presence of electrical contacts thereof.
Figure 8:
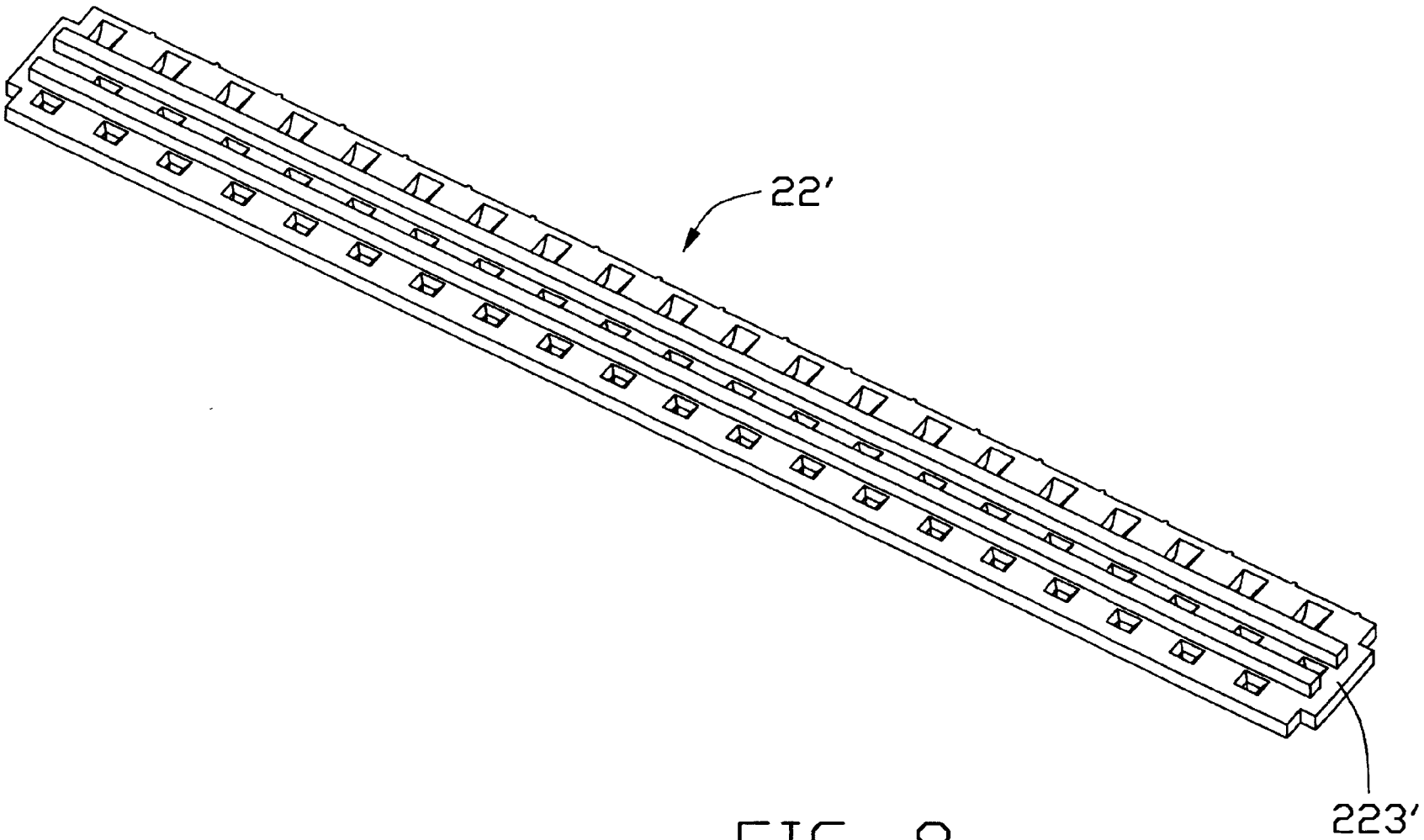
FIG. 8 is a perspective view of a dielectric spacer in accordance with the second embodiment of the present invention.

Referring to FIGS. 7 and 8, an insulative housing 12' in accordance with a second embodiment of the present invention is similar to the insulative housing 12 of the first embodiment but defines cavities 134' in lower sections of the end and the intermediate blocks 125', 126' (not shown) instead of the step portions 134 with the channels 135. Accordingly, a dielectric spacer 22' of the second embodiment is similar to the dielectric spacer 22 of the first embodiment except that a pair of extensions 223' extend outwardly from two opposite ends thereof to engage with the cutouts 134' of the insulative housing 12' to provide a retention between the dielectric spacers 22' and insulative housing 12'.

Figure 9:
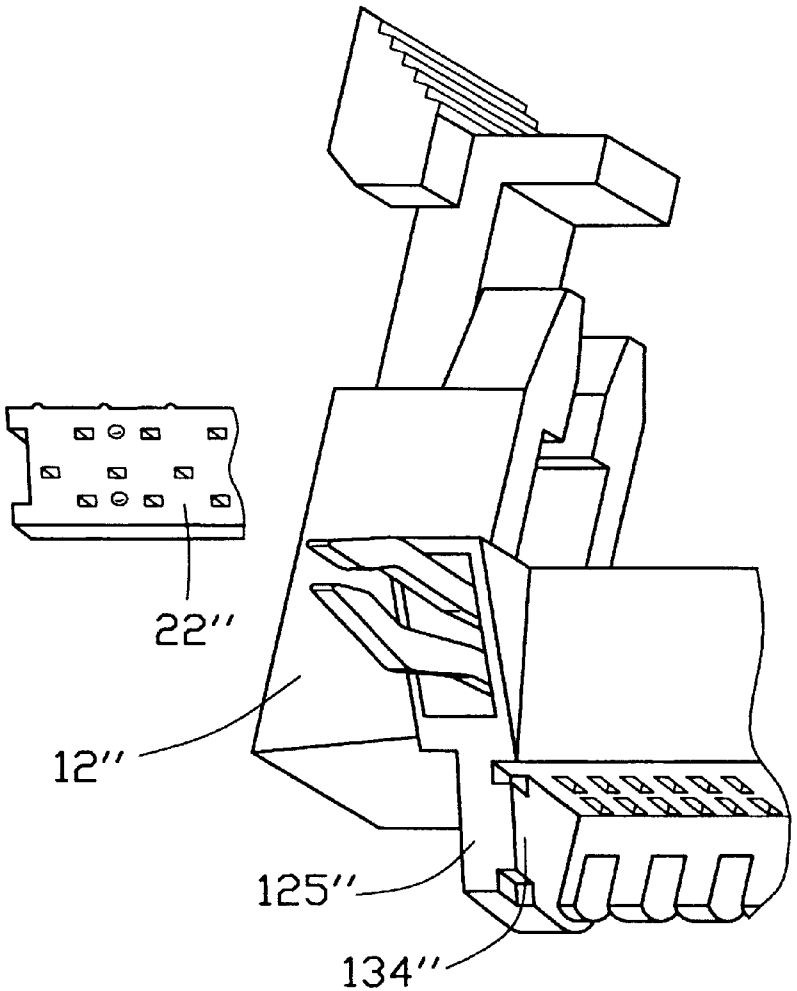
FIG. 9 is a partly enlarged view of an electrical connector in accordance with a third embodiment of the present invention with the absence of electrical contacts thereof.
Figure 10:
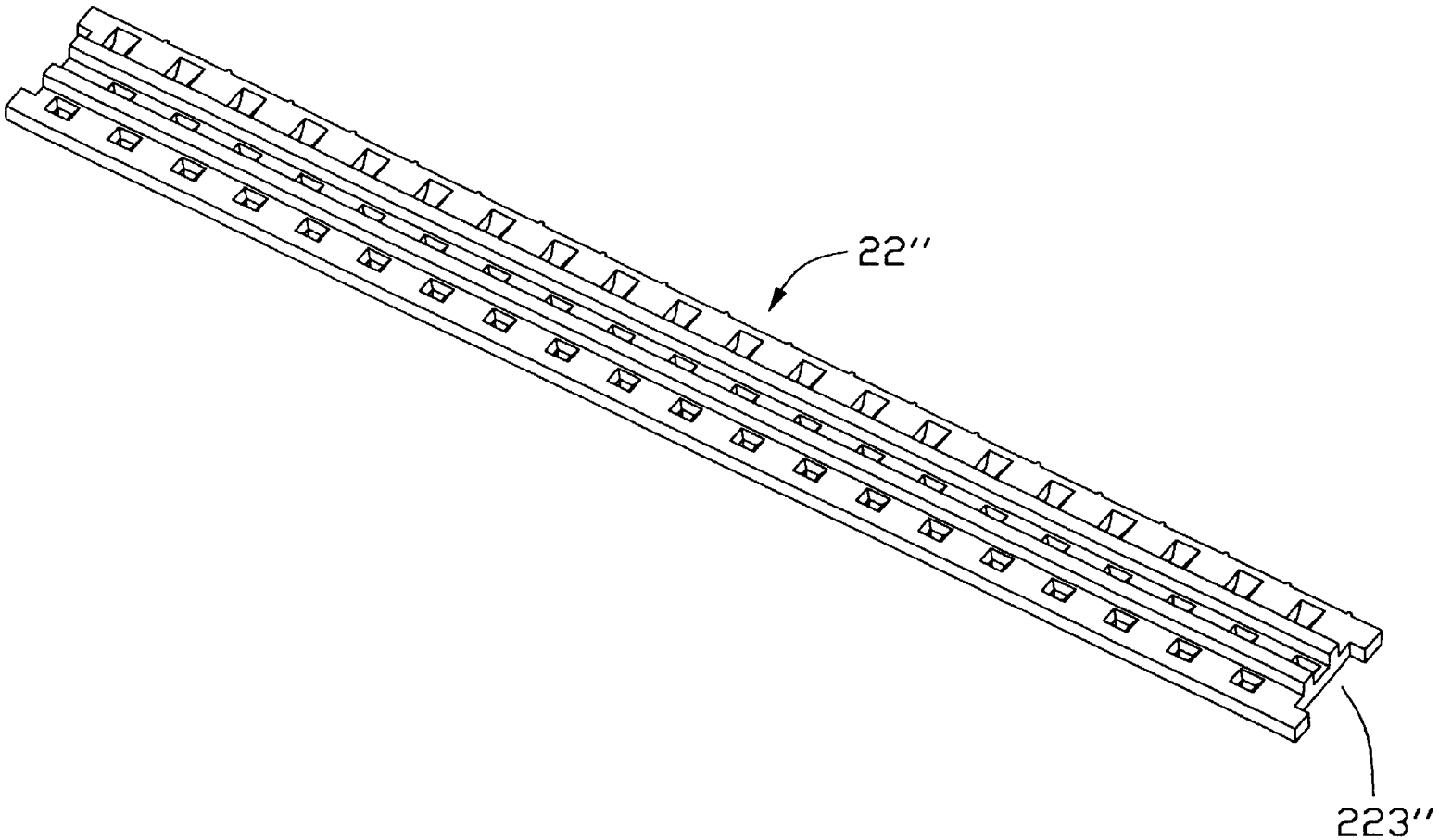
FIG. 10 is a perspective view of a dielectric spacer in accordance with the third embodiment of the present invention.

Referring to FIGS. 9 and 10, an insulative housing 12" in accordance with a third embodiment of the present invention is similar to the insulative housing 12 of the first embodiment but is formed with protrusions 134" in lower sections of the end and the intermediate blocks 125", 126" (not shown) instead of the step portions 134 with the channels 135. Accordingly, a dielectric spacer 22" of the third embodiment is similar to the dielectric spacer 22 of the first embodiment except that a cutout 223" is defined in each of two opposite ends thereof to engage with the protrusions 134" of the insulative housing 12" for providing a retention therebetween.

The positions of the tails of the electrical contacts of the electrical connecter are ensured since the dielectric spacers 22, 22', and 22" are retained to the insulative housing 12, 12', and 12" by the engagements between the opposite ends with the ribs 221 and the step portions 134 with the channels 135, between the extensions 223' and the cavities 134', and between the cutouts 223" and the protrusions 134", respectively, which are comparatively simple and are easy to form in producing.

It is to be understood, however, that even though numerous characteristics and advantages of the present invention have been set forth in the forgoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising an elongated body portion along a lengthwise direction thereof, said housing having a receiving slot, and a plurality of blocks extending from the body portion;

a plurality of electrical contacts each comprising a contact portion received in the insulative housing and exposed to the receiving slot, and at least two rows of tail portions extending out from a rear portion of the body portion; and a dielectric spacer being retained to the blocks of the insulative housing and comprising a plurality of through holes to receive the tails of the electrical contacts to extend therethrough; wherein the plurality of blocks of the insulative housing comprise an end block and an intermediate block, and the dielectric spacer is retained between the end block and the intermediate block; wherein each of the end and the intermediate blocks is formed with a step portion on an end face of each block, and the dielectric spacer comprises a pair of opposite ends to engage with the step portions; wherein each of the step portions defines a pair of channels, and the dielectric spacer comprises on a top face thereof a pair of elongated ribs extending upwardly and located between said at least two rows of tail portions along said lengthwise direction to not only separate said at least two rows of tail portions but also be retainably engaged within the corresponding channels around two opposite ends thereof; wherein the insulative housing comprises a pair of shoulders extending at two opposite ends of the body portion and each defining a bottom face, and the body portion defines a bottom face flush with the bottom faces of the shoulders to define a first plane, the end and the intermediate blocks comprising bottom faces flush with each other to define a second plane defining an acute angle with respect to the first plane.

* * * * *